US009803355B1

(12) United States Patent
Ripley et al.

(10) Patent No.: US 9,803,355 B1
(45) Date of Patent: Oct. 31, 2017

(54) MASONRY VENEER TIE

(71) Applicant: Masonry Reinforcing Corporation of America, Charlotte, NC (US)

(72) Inventors: George Michael Ripley, Charlotte, NC (US); Ralph O. Johnson, Charlotte, NC (US)

(73) Assignee: Masonry Reinforcing Corporation of America, Charlotte, NC (US)

( * ) Notice: Subject to any disclaimer, the term of this patent is extended or adjusted under 35 U.S.C. 154(b) by 0 days.

(21) Appl. No.: 15/234,043

(22) Filed: Aug. 11, 2016

(51) Int. Cl.
*E04B 1/14* (2006.01)
*E04B 1/41* (2006.01)

(52) U.S. Cl.
CPC ..... *E04B 1/4178* (2013.01)

(58) Field of Classification Search
CPC ..... E04B 1/4178; E04B 1/4185; F16B 35/06
See application file for complete search history.

(56) References Cited

U.S. PATENT DOCUMENTS 4,764,069 A * 8/1988 Reinwall et al. ... B25B 13/5091 411/397
7,152,382 B2 12/2006 Johnson, III
7,415,803 B2 * 8/2008 Bronner ..... F16B 37/16 52/377
7,717,015 B2 * 5/2010 Nilsen et al. ..... B25B 13/065 411/396
8,037,653 B2 * 10/2011 Hohmann, Jr. ..... E04B 1/4178 52/379
8,109,706 B2 * 2/2012 Richards ..... E04B 1/4178 408/227
8,418,422 B2 4/2013 Johnson, III
8,516,768 B2 8/2013 Johnson, III
8,544,228 B2 * 10/2013 Bronner ..... E04B 1/4178 52/378
8,555,596 B2 * 10/2013 Hohmann, Jr. ..... E04B 1/4178 52/379
8,596,010 B2 * 12/2013 Hohmann, Jr. ..... E04B 1/4178 52/561
8,661,766 B2 * 3/2014 Hohmann, Jr. ..... E04B 1/4178 52/705
8,726,597 B2 * 5/2014 Hohmann, Jr. ..... E04F 13/0805 52/379
8,863,469 B2 * 10/2014 Curtis et al. ..... E04B 1/4178 52/379

(Continued)

OTHER PUBLICATIONS

Wire-Bond, Sure-Tie Product Submittal, undated, 4 pages.

(Continued)

*Primary Examiner* — Andrew J Triggs
(74) *Attorney, Agent, or Firm* — Shumaker, Loop & Kendrick, LLP

(57) ABSTRACT

A veneer tie for connecting together an outer wall and an inner wall spaced-apart from the outer wall and defining a cavity therebetween. The veneer tie includes a screw anchor, including an elongate shaft for penetrating into the inner wall, a head formed on one end of the screw anchor and an opening formed in the head. A pintle adapted for engaging and being carried by the head of the screw anchor is provided, and extends outwardly from the head and bridges the cavity between the outer wall and the inner wall. The pintle has at least one hook for extending through the opening formed in the head for connecting the pintle to the screw anchor.

13 Claims, 4 Drawing Sheets

(56) References Cited

U.S. PATENT DOCUMENTS 8,910,445 B2 * 12/2014 Hohmann, Jr. ..... E04B 1/4178 52/565
9,140,001 B1 * 9/2015 Hohmann, Jr. ..... E04B 1/4178
9,260,857 B2 * 2/2016 Hohmann, Jr. ..... E04B 1/4178
9,334,646 B2 * 5/2016 Hohmann, Jr. ..... E04B 1/4178
2002/0100239 A1 * 8/2002 Lopez ..... E04B 1/4178 52/379
2005/0279042 A1 * 12/2005 Bronner ..... F16B 37/16 52/513
2005/0279043 A1 * 12/2005 Bronner ..... F16B 37/16 52/561
2008/0141605 A1 * 6/2008 Hohmann ..... E04B 1/4178 52/408
2008/0295651 A1 * 12/2008 Nilsen et al. ..... B25B 13/065 81/180.1
2009/0133357 A1 * 5/2009 Richards ..... E04B 1/4178 52/698
2010/0037552 A1 * 2/2010 Bronner ..... E04B 1/4178 52/713
2011/0047919 A1 * 3/2011 Hohmann, Jr. ..... E04B 1/4178 52/513
2011/0094176 A1 * 4/2011 Bronner ..... E04B 1/4178 52/506.05
2012/0291390 A1 * 11/2012 Hohmann, Jr. ..... E04B 1/4178 52/565
2012/0304576 A1 * 12/2012 Hohmann, Jr. ..... E04B 1/4178 52/513
2013/0232909 A1 * 9/2013 Curtis et al. ..... E04B 1/4178 52/704
2013/0340371 A1 * 12/2013 Bronner ..... E04B 1/4178 52/562
2014/0075855 A1 * 3/2014 Hohmann, Jr. ..... E04F 13/0805 52/167.1
2014/0260040 A1 * 9/2014 Hohmann, Jr. ..... E04B 1/7616 52/483.1
2014/0260051 A1 * 9/2014 Hohmann, Jr. ..... E04B 1/4178 52/565
2015/0101278 A1 * 4/2015 Curtis et al. ..... E04B 1/4178 52/704
2016/0010325 A1 * 1/2016 Hohmann, Jr. ..... E04B 1/4178 52/379
2016/0032582 A1 * 2/2016 Hohmann,, Jr. ..... E04B 1/4178 52/703

OTHER PUBLICATIONS

Wire-Bond, Products Catalog dated 2002/2003, 24 pages.
Wire-Bond |Innovation in Masonry Construction, website dated Aug. 16, 2016, http://wirebond.com/, 3 pages.
An excerpt of "2-Seal TIE™ Veneer Anchors", p. 13, undated.
An excerpt of POS-I-TIE® Bock Veneer Anchoring Systems, pp. 5-6, dated 2010-2011.

* cited by examiner

MASONRY VENEER TIE

TECHNICAL FIELD AND BACKGROUND OF THE INVENTION

This invention relates to a masonry veneer tie, particularly a veneer tie of the type suitable for stabilizing a brick or block veneer wall by connecting it across an air gap to a structural wall. It is common in masonry construction for wall structures to include an inner wall to provide structural stability, and a spaced-apart outer veneer wall, typically of brick, principally for aesthetic purposes. Masonry anchors have long been used for anchoring the two walls together to help form a unified wall structure. See, applicant's U.S. Pat. No. 8,418,422.

Prior art masonry anchors are generally made of metal wire and typically include a ladder or truss-type support frame that is positioned in a mortar joint of the inner wall laterally coplanar with a mortar joint in the outer wall. A plurality of brackets extend outwardly from the support frame and have eyes extending into the cavity between the two walls for receiving a connecting member, such as a pintle, having elongate hooks for being positioned in the eyes to thereby form an unitary anchor spanning the cavity. The outer end of the pintle rests on the top surface of the outer wall. Mortar is then filled over the masonry anchor. The process is repeated for successive mortar joints to unify the two walls into a single stable structure.

In geographical areas subject to seismic disturbance, building codes require an anchor whose parts are connected in such a manner as not to disconnect during a seismic disturbance that may cause relative movement between the two walls. The masonry anchor of the present invention is particularly adapted for use in geographical areas subject to seismic instability, and results in improved structural stability in the wall structure. The anchor tie described in this application is readily and easily installed in the wall structure during construction without the need of special tools, jigs or fixtures. The anchor is characterized by two anchor elements being locked together in a manner that prevents their separation even under extreme pressure and movement.

The veneer tie is particularly adapted for connecting an outer brick or block veneer wall to an inner wall of some other material, such as an insulated wallboard fastened to laterally spaced-apart, vertically extending studs.

SUMMARY OF THE INVENTION

It is therefore an object of the present invention to provide an efficient and effective way of attaching a brick or block veneer wall to a spaced-apart structural wall.

These and other objects and advantages of the invention are achieved by providing a veneer tie for connecting together an outer wall and an inner wall spaced-apart from the outer wall defining a cavity therebetween, and including a screw anchor, including an elongate shaft for penetrating into the inner wall, an enlarged head formed on one end of the screw anchor and an opening formed in the head, and a pintle adapted for engaging and being carried by the head of the screw anchor, extending outwardly from the head, being attached to the outer wall and bridging the cavity between the outer wall and the inner wall, the pintle including at least one hook for extending through the opening formed in the head for connecting the pintle to the screw anchor.

According to another embodiment of the invention, the pintle includes spaced-part side walls for being embedded in a mortar joint in the outer wall, two laterally spaced-apart hooks, and the opening comprises a slot having a sufficient width to accommodate the two hooks.

According to another embodiment of the invention, the pintle is formed of metal wire having three spaced-apart sides defining a void and integrally-formed converging transitions at respective first and second free ends of which are positioned the two hooks.

According to another embodiment of the invention, the two laterally spaced-part hooks each include a bend for raising a topmost part of the hooks above a plane of the pintle.

According to another embodiment of the invention, the hooks are spaced-part by a distance less than one-half of a spacing between the two spaced-part sides of the pintle.

According to another embodiment of the invention, the pintle and the screw anchor are each formed of wire.

According to another embodiment of the invention, the two hooks have a nominal space between each other that is greater than the predetermined width of the slot in the head of the screw anchor, and the pintle is compressible to move the hooks to a spaced-apart position where the two hooks will fit into the slot thereby connecting together the pintle and the screw anchor.

According to another embodiment of the invention, screw threads are positioned proximate an end of the screw anchor remote from the head, and an enlarged ring is positioned on the shaft of the screw anchor adjacent the head and between the head and the screw threads for preventing the screw anchor from pulling through the inner wall.

According to another embodiment of the invention, a washer is provided for being positioned between the head and the inner wall to prevent air and moisture penetration through the inner wall past the screw anchor.

According to another embodiment of the invention, a veneer tie is provided for connecting together an outer wall and an inner wall spaced-apart from the outer wall and defining a cavity therebetween, and includes a screw anchor, including an elongate shaft for penetrating into the inner wall, a head on one end of the screw anchor having a slot of a predetermined width formed in the head, and a self-tapping tip formed on an end of the shaft remote from the head. A wire pintle is adapted for engaging and being carried by the head of the screw anchor, extending outwardly from the head and into a mortar joint of the outer wall, thereby bridging the cavity between the outer wall and the inner wall. The pintle includes first and second spaced-apart hooks for extending through the slot formed in the head for connecting the pintle to the screw anchor.

According to another embodiment of the invention, the pintle includes two spaced-part sides defining a void, wherein the sides are spaced-apart by a distance and an integrally-formed converging transition.

According to another embodiment of the invention, the transition defines two laterally spaced-part hooks for being positioned in the slot in the head of the screw anchor.

According to another embodiment of the invention, the screw anchor is a unitary structure.

BRIEF DESCRIPTION OF THE DRAWING FIGURES

The present invention is best understood when the following detailed description of the invention is read with reference to the accompanying drawings, in which.

DETAILED DESCRIPTION OF THE PREFERRED EMBODIMENT

Figure 1:
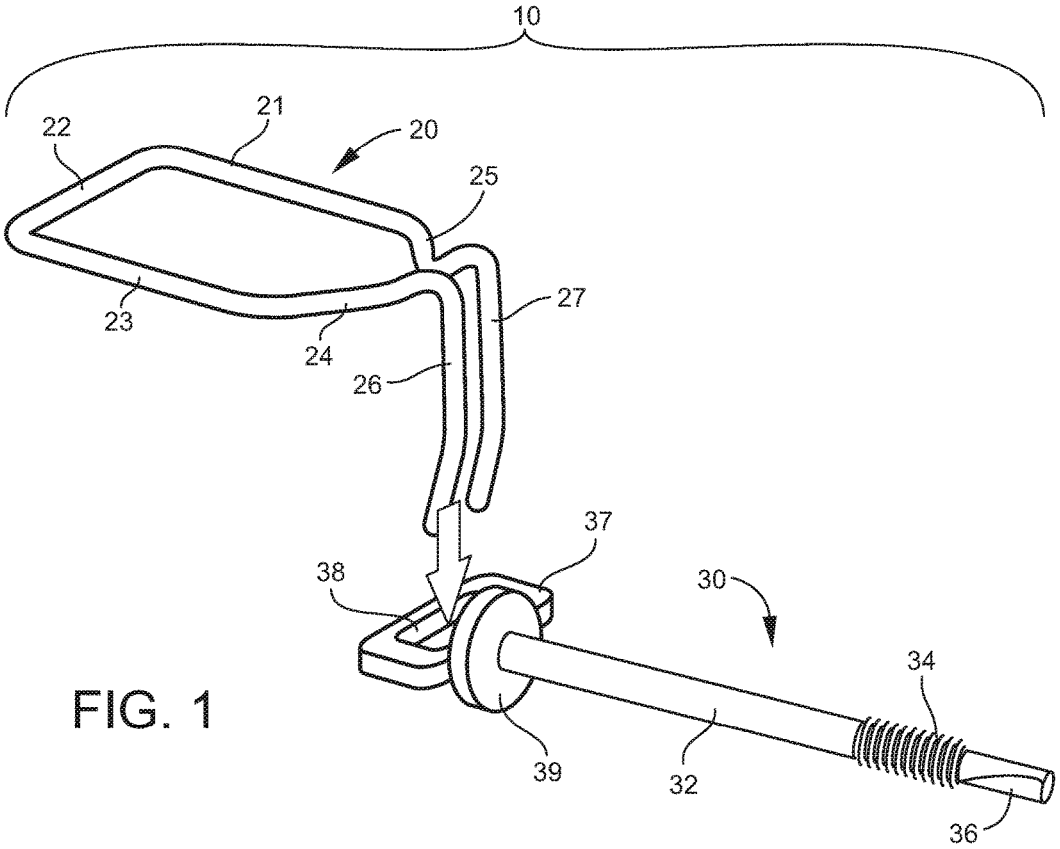
FIG. 1 is a perspective view of the pintle screw anchor prior to assembly, according to an embodiment of the present invention.

Referring now to the drawings, a masonry veneer tie is according to one preferred embodiment of the invention shown in FIG. 1 and identified as reference numeral 10. The masonry veneer tie 10 is formed of two major components, a pintle 20 and an anchor screw 30. The pintle 20 is preferably formed of a single length of wire, for example, galvanized wire, bent to form three spaced-apart sides 21, 22 and 23. A suitable material conformance for the pintle 20 and anchor screw 30 is an ASTM A82/A82M cold drawn steel wire having a tensile strength of 80,000 psi and a yield point of 70,000 psi, conforming to TMS 602 building code requirements for masonry structures. The steel is preferably ASTM 580/ASTM 580M Type 304, hot dip galvanized after fabrication according to ASTM A 153/A153M-B2.

The opposing sides 21 and 23 converge to form transitions 24 and 25. The transitions 24, 25 are bent to form elongate hooks 26, 27 that have a slight curve back towards the transitions 24, 25. Also, note that the hooks 26, 27 have an upward bend at a proximal end of the respective transitions 24, 25 for raising a topmost part of the hooks 26, 27 above the plane of the pintle 20.

The anchor screw 30 is formed of an elongate shaft 32. Threads 34 are preferably formed proximate one end of the shaft 32, with an optional hardened, self-tapping tip 36 formed on the end of the shaft 32. The other end of the shaft 32 includes an enlarged head 37 in which is formed an opening, such as an elongate slot 38. The anchor screw 30 is preferably a unitary structure. An enlarged ring 39 of metal, durable plastic or other suitable material, is positioned adjacent the head 37.

Figure 2:
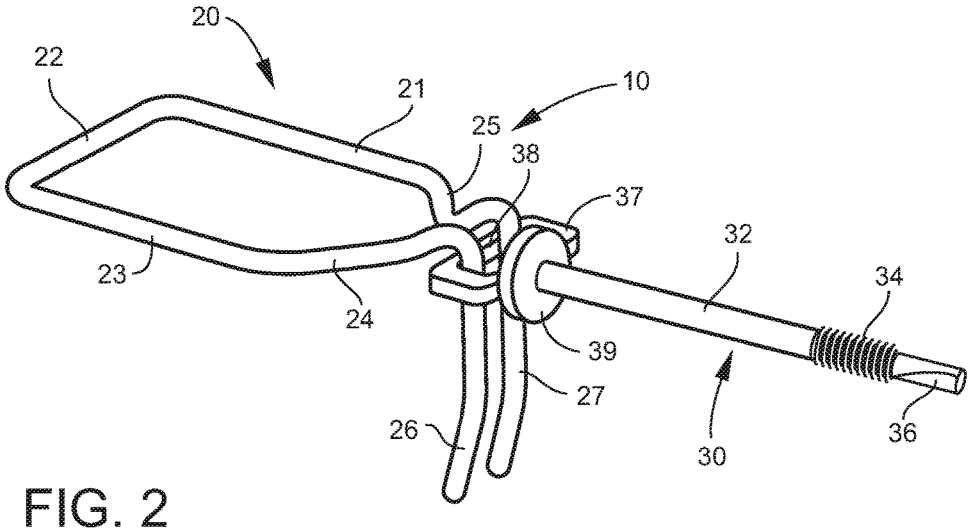
FIG. 2 is a perspective view of a masonry veneer tie showing the pintle inserted into the anchor screw according to an embodiment of the present invention.

FIG. 2 shows the pintle 20 properly positioned with the hooks 26, 27 positioned in the slot 38 in the head 37.

Figure 3:
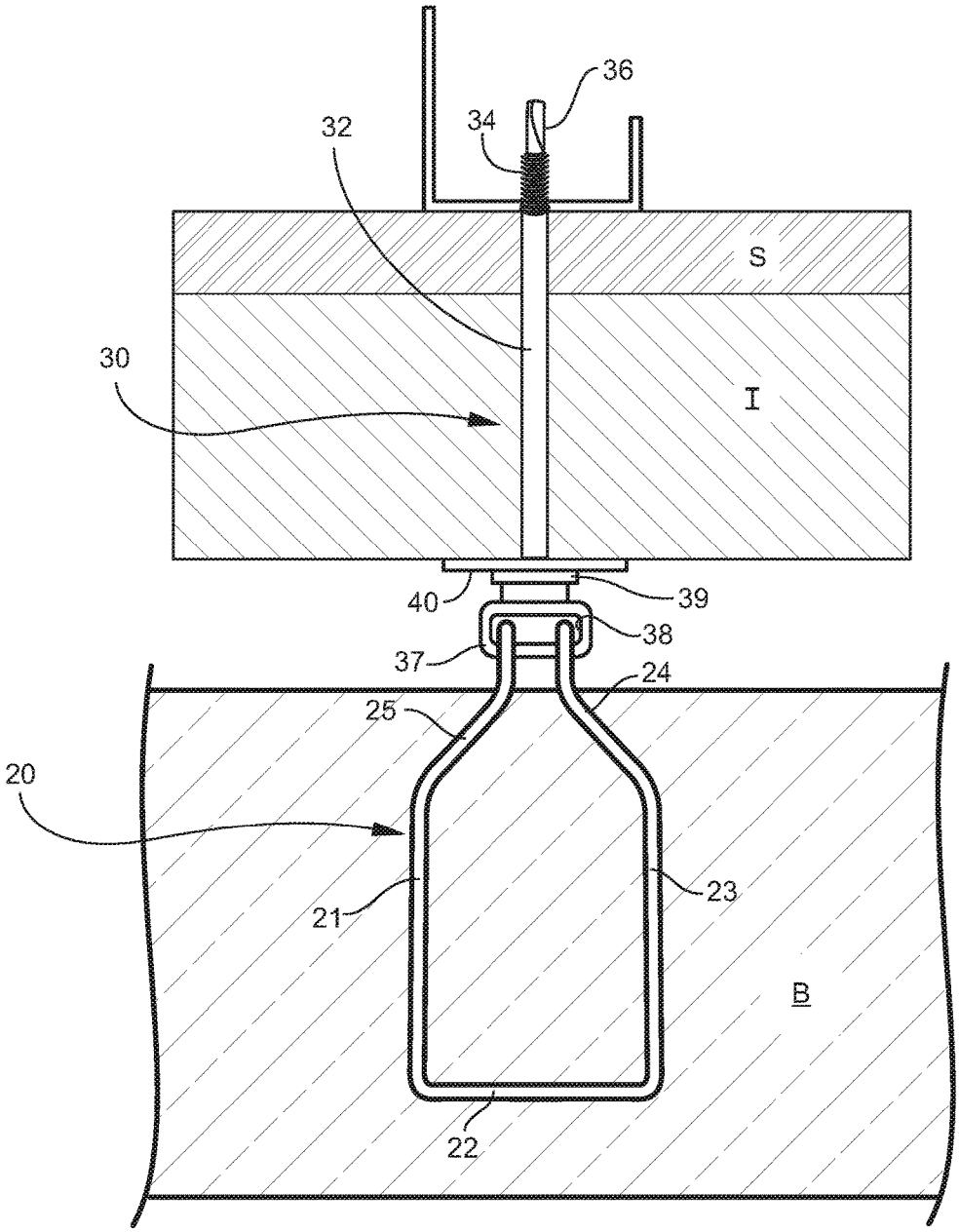
FIG. 3 is a top plan view of an outer brick veneer wall and an inner structural wall connected together with a veneer tie according to an embodiment of the present invention.

Referring now to FIG. 3, proper installation and functionality of the masonry veneer tie 10 is explained and illustrated. The veneer tie 10 functions to securely anchor a veneer wall of masonry, such as brick or block, to a structural wall. As shown by way of example in FIG. 3, a brick veneer wall "B" is anchored to a sheet of wallboard "S". A sheet of insulation material "I" is positioned between the brick veneer wall "B" and the wallboard "S". This structural wallboard "S" is fastened to vertically extending, laterally spaced-part studs. To provide a higher insulation value, an air gap cavity is provided between the inner side of the veneer wall "B" and the outer side of the insulation material "I". The masonry veneer tie 10 bridges this cavity by connecting together the veneer wall "B" and the insulation wall "I" and the wallboard "S". This is accomplished by positioning veneer ties 10 at both horizontal and vertical intervals along the width and height of the wall.

The pintles 20 are embedded in the horizontal mortar joints between courses of brick or block in a predetermined spacing, as may be called for the building codes, engineering specifications or otherwise. When the mortar hardens, the pintles 20 become an integral part of the mortar joint.

The screw anchors 30 are screwed into the structural wall at the level of the mortar joint into which the pintles 20 are to be embedded. Once screwed into the structural wall, the slot 38 in the head 37 receives the two hooks 26 and 27. This positions the sides 21, 22 and 23 at the correct distance and spacing, at which time it is physically pressed into the fresh mortar troweled into the mortar joint. When the mortar hardens, the numerous veneer ties 10 positioned along the length and height of the veneer wall and structural wall provide substantial strength to the connected walls.

An optional ring 39 may be used to spread the force applied to the screw anchor 30 and prevents the screw anchor from being driven too far into the structural wall "S". The screw threads 34 provide a positive fixation of the screw anchor 30 in the structural wall "S" and the stud. The self-tapping tip 36 is useful when steel wall studs are used to enable the screw anchor 30 to penetrate through the wall of the stud, as shown in FIG. 3.

Figure 4:
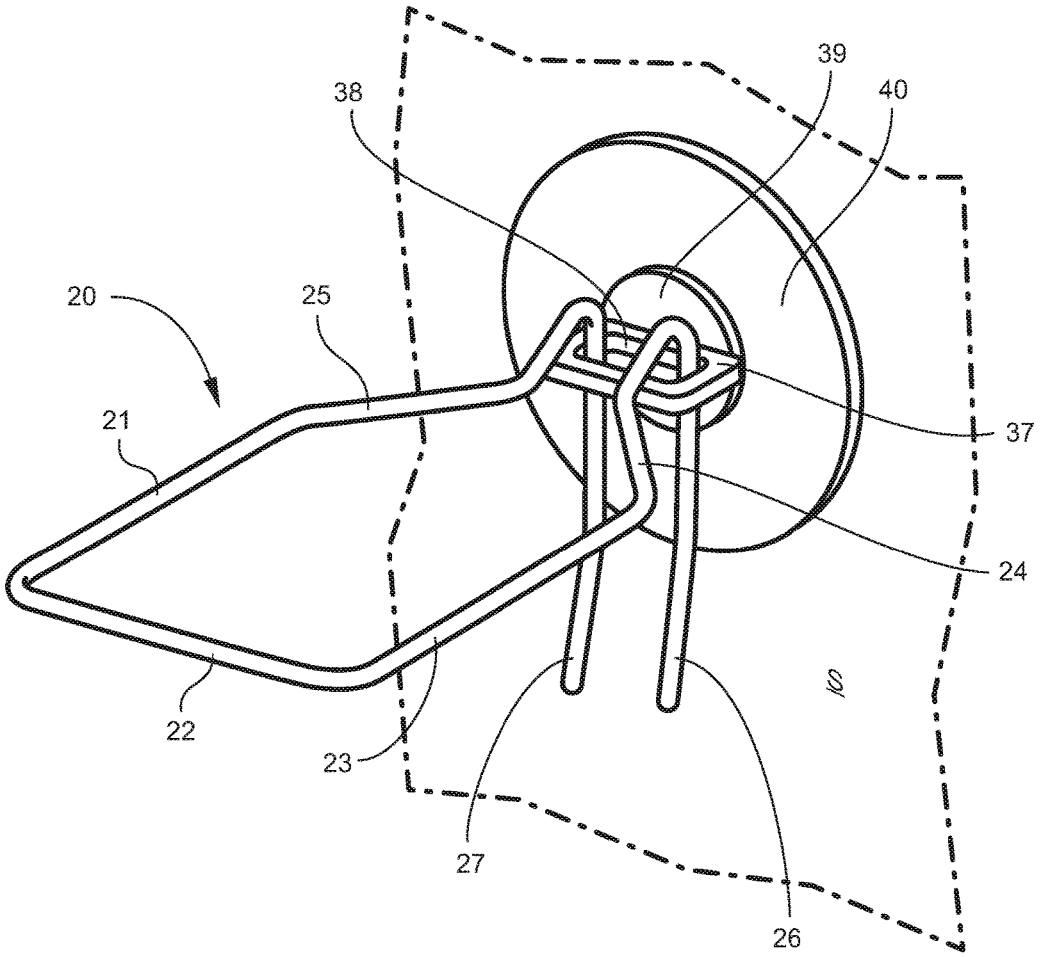
FIG. 4 is a perspective view of the arrangement shown in FIG. 3.

As best shown in FIGS. 3 and 4, an optional washer 40 formed of rubber, soft plastic or other material can be placed between the ring 39 and the outer surface of the insulation material "I:. When the screw anchor 30 is driven into the insulation material "I", the ring 39 flattens the washer 40 against the outer surface of the insulation material "I", preventing air and moisture penetration.

According to one preferred embodiment of the invention, the two hooks 26, 27 have a nominal space between each other that is greater than the width of the slot 38 in the head 37 of the screw anchor 30. The side walls 21, 23 of the pintle 20 can be manually squeezed together to move the hooks 26, 27 to a spaced-apart position where they will fit into the slot 38 thereby connecting together the pintle 20 and the screw anchor 30. When the squeezing pressure on the side walls 21, 23 is released, the outward movement of the hooks 26, 27 against the walls of the slot 38 provides an enhanced connection between the pintle 20 and screw anchor 30.

Figure 5:
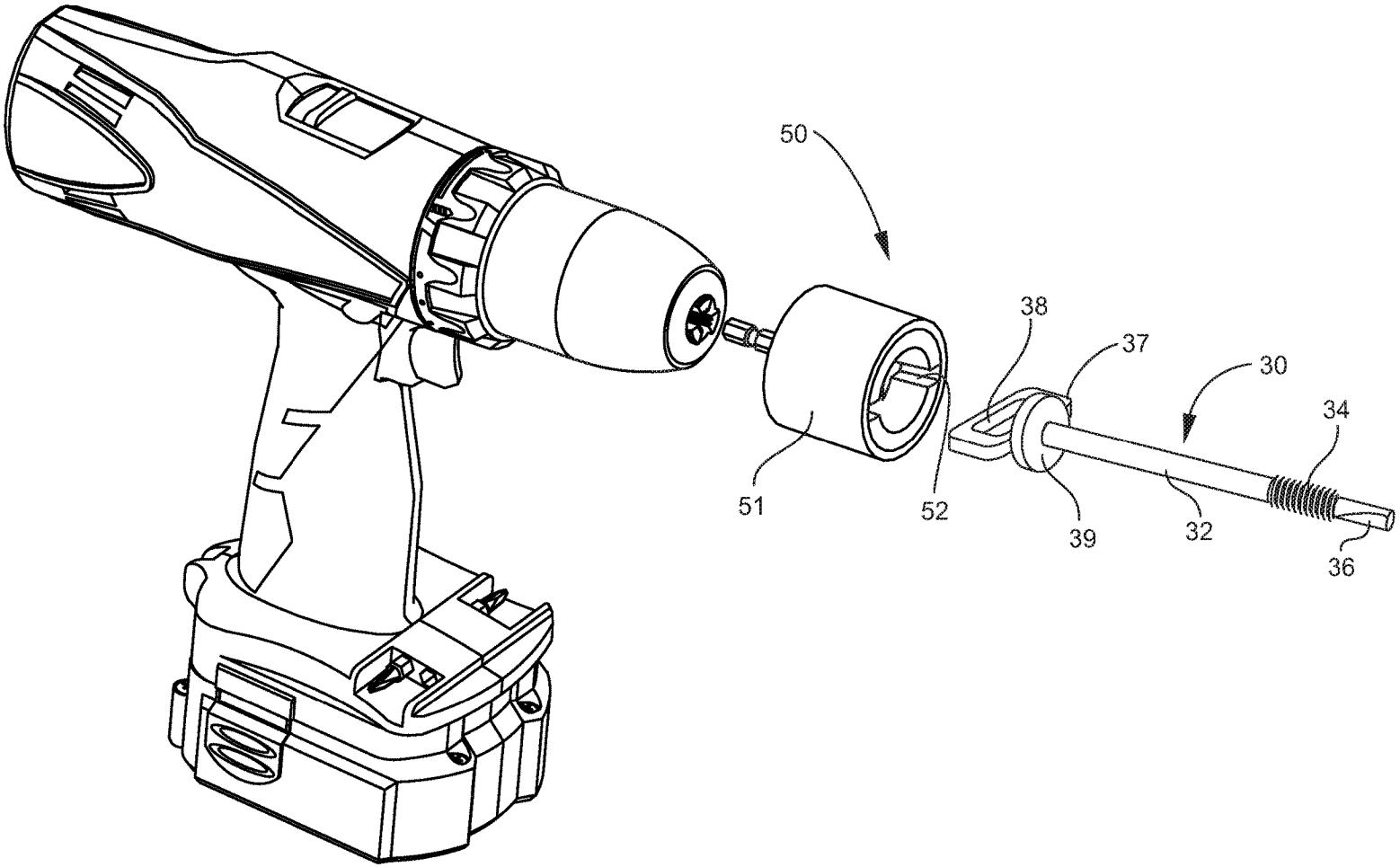
FIG. 5 is a perspective view showing a chuck adapter suitable for driving the anchor screw.

As shown in FIG. 5, the screw anchor 30 can be driven into the structural wall with a power drill equipped with a chuck adaptor 50, which includes a collar 51 having a slot 52 that will receive the head 37. The only adjustment required is to position the head 37 in a position whereby the slot 38 extends laterally from side-to-side to receive the hooks 26, 27.

Variations in the design specifics described above are contemplated. For example, the shape defined by the side wall of the pintle can have any suitable configuration, as can the shape and spacing of the hooks. Where the studs in the structural wall are wood, an anchor screw with threads and a tip suitable for wood can be used.

A masonry veneer tie according to the invention has been described with reference to specific embodiments and examples. Various details of the invention maybe changed without departing from the scope of the invention. Furthermore, the foregoing description of the preferred embodiments of the invention and best mode for practicing the invention are provided for the purpose of illustration only and not for the purpose of limitation, the invention being defined by the claims.

We claim:

1. A veneer tie for connecting together an outer wall and an inner wall spaced-apart from the outer wall defining a cavity therebetween, and comprising:

(a) a unitary screw anchor, including:

(i) an elongate shaft for penetrating into the inner wall;

(ii) an enlarged head having an elongate slot for being positioned to extend laterally along the inner wall;

(iii) an enlarged support ring positioned directly adjacent the enlarged head;

(iv) an elongate, unthreaded, solid shalt segment having a single, uniform diameter;

(v) a screw thread segment positioned on the shaft segment remote from the enlarged support ring; and (vi) a self-tapping tip segment formed on an end of the shaft segment adjacent the screw thread segment and remote from the enlarged head, the diameter of the screw thread segment being greater than the diameter of the shaft segment and the self-tapping tip segment and smaller than a diameter of the enlarged support ring; and (b) a pintle adapted for engaging and being carried by the head of the screw anchor, extending outwardly from the head, adapted for being attached to the outer wall and bridging the cavity between the outer wall and the inner wall, the pintle including at least one hook for extending through the slot formed in the head for connecting the pintle to the screw anchor.

2. A veneer tie according to claim 1, wherein the at least one hook comprises two laterally spaced-apart hooks and the pintle is formed of metal wire having three spaced-apart sides defining a void and integrally-formed converging transitions having respective first and second free ends on which are positioned the two hooks.

3. A veneer tie according to claim 2, wherein the two laterally spaced-apart hooks each include a bend for raising a topmost part of the hooks above a plane of the pintle.

4. A veneer tie according to claim 3, wherein the hooks are spaced-apart by a distance less than one-half of a spacing between the two spaced-apart sides of the pintle.

5. A veneer tie according to claim 1, wherein the pintle and the screw anchor are each formed of wire.

6. A veneer tie according to claim 1, wherein the at least one hook comprises two laterally spaced-apart hooks and the two hooks have a nominal space between each other that is greater than a predetermined width of the slot in the head of the screw anchor, and further wherein the pintle is compressible to move the hooks to a spaced-apart position where the two hooks will fit into the slot thereby connecting together the pintle and the screw anchor.

7. A veneer tie according to claim 1, and including a washer for being positioned between the head and the inner wall to prevent air and moisture penetration through the inner wall past the screw anchor.

8. A veneer tie according to claim 1, wherein the enlarged head is adapted for being received in a chuck adaptor having an elongate slot for being driven into an attached position by a power drill to which the chuck adaptor is attached.

9. A veneer tie for connecting together an outer wall and an inner wall spaced-apart from the outer wall and defining a cavity therebetween and comprising:

(a) a unitary screw anchor, including:

(i) a wire elongate shaft for penetrating into the inner wall;

(ii) an enlarged head having an elongate slot for being positioned to extend laterally along the inner wall;

(iii) an enlarged support ring positioned directly adjacent the enlarged head;

(iv) an elongate, unthreaded, solid shaft segment having a single, uniform diameter;

(v) a screw thread segment positioned on the shaft segment remote from the enlarged support ring; and (vi) a self-tapping tip segment formed on an end of the shaft segment adjacent the screw thread segment and remote from the enlarged head, the diameter of the screw thread segment being greater than the diameter of the shaft segment and the self-tapping tip segment and smaller than a diameter of the enlarged support ring; and (b) a wire pintle adapted for engaging and being carried by the head of the screw anchor, adapted for extending outwardly from the head and into a mortar joint of the outer wall, thereby bridging the cavity between the outer wall and the inner wall, the pintle including first and second spaced-apart hooks for extending through the slot formed in the head for connecting the pintle to the screw anchor.

10. A veneer tie according to claim 9, wherein the pintle includes two spaced-apart sides defining a void, wherein the sides are spaced-apart by a distance and an integrally-formed converging transition.

11. A veneer tie according to claim 10, wherein the transition defines the two laterally spaced part spaced-apart hooks for being positioned in the slot in the head of the screw anchor.

12. A veneer tie according to claim 9, wherein the pintle includes a spaced-apart side wall for being embedded in a mortar joint in the outer wall, and the slot having a sufficient width to accommodate the two hooks.

13. A veneer tie according to claim 9, wherein the enlarged head is adapted for being received in a chuck adaptor having an elongate slot for being driven into an attached position by a power drill to which the chuck adaptor is attached.

* * * * *